US005487840A

United States Patent [19]

Yabe et al.

[11] Patent Number: 5,487,840

[45] Date of Patent: Jan. 30, 1996

[54] MAGNETIC FLUID COMPOSITION

[75] Inventors: Toshikazu Yabe; Atsuhiro Yamamoto, both of Saitama; Atsushi Yokouchi, Kanagawa; Kunio Esumi, Chiba, all of Japan

[73] Assignee: NSK Ltd., Tokyo, Japan

[21] Appl. No.: 177,471

[22] Filed: Jan. 5, 1994

[30] Foreign Application Priority Data

Jan. 20, 1993 [JP] Japan ..... 5-007729

[51] Int. Cl.[6] ..... H01F 1/44

[52] U.S. Cl. ..... 252/62.51; 252/62.52; 252/62.55; 252/62.56; 252/62.59; 252/62.6; 252/62.62; 252/62.63; 252/62.54

[58] Field of Search ..... 252/62.52, 62.51, 252/62.54, 62.55, 62.56, 62.63, 62.64, 62.6, 62.62, 62.59

[56] References Cited

U.S. PATENT DOCUMENTS

| | | | |
|---|---|---|---|
| 4,976,883 | 12/1990 | Kanno et al. | 252/62.52 |
| 4,992,190 | 2/1991 | Shtarkman | 252/62.52 |
| 5,085,789 | 2/1992 | Yokouchi et al. | 252/62.52 |
| 5,135,672 | 8/1992 | Yabe et al. | 252/62.52 |
| 5,143,637 | 9/1992 | Yokouchi et al. | 252/62.52 |

FOREIGN PATENT DOCUMENTS 3163271 7/1991 Japan .

OTHER PUBLICATIONS

Kaiser et al., *IEEE Transactions on Magnetics,* Sep. 1970, vol. 6(3), pp. 694–698.

Mehta et al., *Journal of Magnetism and Magnetic Materials,* 1983, vol. 39, pp. 35–38. (Month Unknown).

*Primary Examiner*—Prince Willis, Jr.

*Assistant Examiner*—Alan D. Diamond

*Attorney, Agent, or Firm*—Sughrue, Mion, Zinn, Macpeak & Seas

[57] ABSTRACT

A magnetic fluid composition comprising a low-volatile organic solvent as a carrier having dispersed therein ferromagnetic fine particles coated with a surface active agent having a lipophilic group having affinity to said low-volatile organic solvent, and a thixotropy-imparting agent is disclosed. The composition is prevented from splashing for an extended period of time even when used in a magnetic fluid-sealed apparatus operated at such a high speed that the rotational speed of the sealing part is 2 m/sec or higher.

2 Claims, 2 Drawing Sheets

MAGNETIC FLUID COMPOSITION

FIELD OF THE INVENTION

This invention relates to a magnetic fluid composition, and more particularly to a magnetic fluid composition which is effectively prevented from splashing for an extended period of time.

BACKGROUND OF THE INVENTION

Various magnetic fluid compositions have hitherto been proposed for use in magnetic fluid-sealed apparatus, including a dispersion comprising a carrier having stably dispersed therein ferromagnetic fine particles with the aid of a surface active agent carrying a lipophilic group having a similar structure to that of the carrier as disclosed in JP-A-64-27207 (which corresponds to U.S. Pat. No. 5,085,789) (the term "JP-A" as used herein means an "unexamined published Japanese patent application").

A magnetic fluid-sealed apparatus is generally composed of an axis, a housing affording a cylindrical space surrounding the axis, and a magnetic circuit-forming member fitted into the cylindrical space which is composed of a pair of ring pole pieces with a ring permanent magnet being interposed therebetween. A magnetic circuit is formed in such a manner that the magnetic flux flows from the permanent magnet into one of the pole pieces, goes to the other pole piece via the axis, and returns to the permanent magnet. A magnetic fluid composition injected into the ring gap between the periphery of the axis and the inner periphery of the pole pieces is held there by the magnetic force of the magnetic circuit and functions as a magnetic seal.

Known magnetic fluid-sealed apparatus designed to prevent splash of the magnetic fluid seal include the one disclosed in JP-A-3-163271. The disclosed magnetic fluid-sealed apparatus is characterized in that a second permanent magnet is provided between one of the pole pieces and a roller bearing to increase the magnetic flux toward one of the pole pieces and thereby control the excess of the magnetic fluid composition held in the gap between the periphery of the axis and the inner periphery of the other pole piece thereby to prevent splash.

Further, a magnetic fluid composition having improved anti-splash properties and a magnetic fluid-sealed apparatus using the same is disclosed in Japanese Patent Application No. Hei-4-55443, in which a low-volatile organic solvent constituting the magnetic fluid composition as a carrier has an increased viscosity so that the viscosity of the magnetic fluid composition may fall within a certain range.

However, where the above-mentioned conventional magnetic fluid-sealed apparatus is operated by rotating the housing at such a high speed that the rotational speed at the sealing part reaches 2 m/sec or even higher, the magnetic fluid composition applied in an amount necessary for forming a ring seal cannot be sufficiently held due to the high centrifugal force, resulting in splash of the fluid. It has therefore been demanded to further improve anti-splash properties of a magnetic fluid composition to be used in a magnetic fluid-sealed apparatus.

On the other hand, the ferromagnetic fine particles dispersed in a carrier with the aid of a surface active agent tend to aggregate and be localized in the composition with time, which also makes the composition liable to splash.

Splash of a magnetic fluid composition causes dust of the ferromagnetic fine particles or shortage of the magnetic fluid composition in the sealing part and a reduction in pressure resistance of the sealing part, resulting in the failure of functioning as a dust seal.

SUMMARY OF THE INVENTION

An object of the present invention is to provide a magnetic fluid composition which is prevented from splashing for a long period of time even when used in a magnetic fluid-sealed apparatus operated at such a high speed that the rotational speed of the sealing part is 2 m/sec or higher.

The present invention provides a magnetic fluid composition comprising a low-volatile organic solvent as a carrier having dispersed therein ferromagnetic fine particles coated with a surface active agent having a lipophilic group having affinity to the low-volatile organic solvent, and a thixotropy-imparting agent (hereinafter referred to as a thixotropic agent).

DETAILED DESCRIPTION OF THE INVENTION

The magnetic fluid composition according to the present invention contains a thixotropic agent which is capable of imparting thixotropic properties at a small amount and forms a network structure in a carrier. Therefore, the magnetic fluid composition applied to a magnetic fluid-sealed apparatus in a sufficient amount for ring seal formation exhibits high anti-splash properties against centrifugal force even when the apparatus is rotated at such a high speed that the rotational speed of the sealing part reaches 2 m/sec or more.

Figure 1:
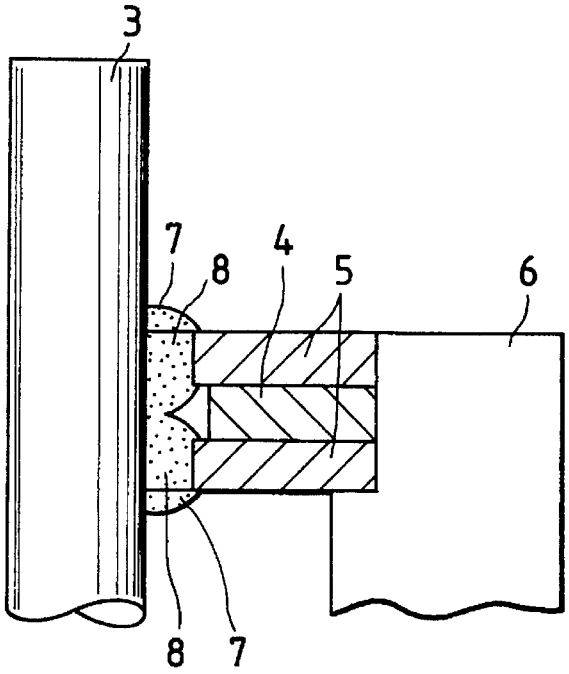
FIG. 1 is a schematic view illustrating a seal model of a magnetic fluid composition in a magnetic fluid-sealed apparatus.

As shown in FIG. 1, a magnetic fluid composition applied to seal gap 8 between axis 3 and pole pieces 5 protrudes over the level of each pole piece 5 to form protrusions 7 due to weaker magnetic attraction, and splash of the composition seems to occur when the centrifugal force by high-speed rotation surpasses the magnetic attraction exercised on these protrusions. It is thus understood that prevention of splash at protrusions 7 will be effective. A permanent magnet 4 and housing 6 are also shown in FIG. 1.

Containing a thixotropic agent, the magnetic fluid composition of the present invention has the property of softening and decreasing in viscosity on being fluidized under stress and again hardening and increasing in viscosity on removal of the stress. Accordingly, where it is applied to an apparatus, for example, the one shown in FIG. 1, the viscosity of the composition at seal gap 8 decreases on receipt of the shear stress, whereas protrusions 7 on which the shear stress exerted is reduced maintain a high viscosity.

Figure 2:
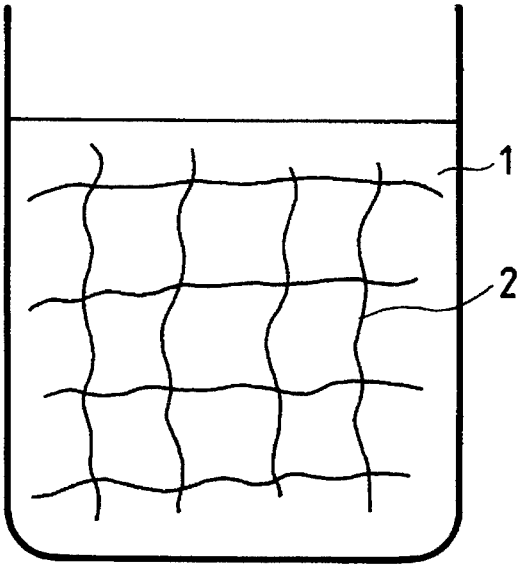
FIG. 2 is a schematic view illustrating the state of a thixotropic agent in a carrier.

The thixotropic agent exists in a carrier 1 in a network structure as shown in FIG. 2. In addition, the network structure of the thixotropic agent 2 increases its strength upon being allowed to stand still. Therefore, even where an apparatus sealed with the magnetic fluid composition of the present invention is suspended from operation for a long time, i.e., the seal ring is kept still long, ferromagnetic particles dispersed in a carrier are effectively prevented from aggregating and being localized with time. As a result, the change in pressure resistance of the sealing part with time can be inhibited, and excellent anti-splash properties can be exercised for a prolonged period of time.

By virtue of the above-described mode of action, the magnetic fluid composition according to the present invention copes with high-speed operation of a magnetic fluid-sealed apparatus, always exhibiting excellent anti-splash properties.

The thixotropic agent which can be used in the present invention includes organic modified bentonite, lipophilic smectite, organic surface-modified precipitated calcium carbonate of calcite structure, hydrogenated castor oil, a fatty acid amide, anhydrous silica, and a swelling mica-organic substance complex. Among them, organic modified bentonite and lipophilic smectite are preferred. These thixotropic agents may be used either individually or in combination of two or more thereof.

The thixotropic agent is preferably used in an amount of from about 0.2 to about 3.0% by weight based on the magnetic fluid composition. If the amount of the thixotropic agent is less than about 0.2%, the composition tends to exhibit insufficient thixotropy, failing to have insufficient anti-splash properties. Besides, the network structure formed in a carrier tends to become incomplete, failing to maintain sufficient anti-splash properties for an extended period of time. On the other hand, if the amount of the thixotropic agent exceeds about 3.0% by weight, the viscosity of the magnetic fluid composition tends to be excessively increased, making it difficult to inject the composition in the seal gap, that is, deteriorating the workability.

It is preferable to select the optimum mode of addition of the thixotropic agent according to the kind thereof. For example, in using organic modified bentonite as a thixotropic agent, a recommended mode of addition for making the full use of its thixotropy-imparting function comprises adding thereto a polar active agent (solvation accelerator), such as propylene carbonate, stirring the mixture in a solvent, e.g., toluene, while applying a moderately strong shearing force by means of, for example, a ball mill, a high-speed dispersing machine, a three-roll mill, etc., mixing the resulting organic modified bentonite dispersion and a low-volatile organic solvent-based magnetic fluid composition separately prepared in a known manner, and removing the solvent used in the organic modified bentonite dispersion by heating in an evaporator to obtain a low-volatile organic solvent-based magnetic fluid composition having dispersed therein organic modified bentonite.

In using a solvent mixing type inorganic thixotropic agent, e.g., lipophilic smectite, the magnetic fluid composition of the present invention is preferably prepared by mixing lipophilic smectite once dispersed in a solvent, e.g., toluene, and a separately prepared conventional low-volatile organic solvent-based magnetic fluid composition and removing the solvent used in the lipophilic smectite dispersion by heating in an evaporator.

In using a solventless type inorganic thixotropic agent, e.g., anhydrous silica, a swelling mica-organic substance complex or organic surface-modified precipitated calcium carbonate of calcite structure, the magnetic fluid composition is preferably prepared by adding the thixotropic agent to a separately prepared conventional low-volatile organic solvent-based magnetic fluid composition and stirring the mixture while applying a somewhat strong shearing force.

In using an organic thixotropic agent, e.g., hydrogenated castor oil or a fatty acid amide, the magnetic fluid composition is preferably prepared by stirring a conventional low-volatile organic solvent-based magnetic fluid composition under a relatively weak stirring force by means of, for example, a propeller mixer while heating at a given temperature and mixing the thixotropic agent therewith while maintaining the above stirring and heating conditions. The heating temperature is preferably about 5° to 10° C. lower than the temperature at which the organic thixotropic agent added is dissolved in the low-volatile organic solvent-based magnetic fluid composition.

The low-volatile organic solvent which can be used as a carrier means an organic solvent having a raper pressure of $10^{-1}$ Torr or less at 20° C. Examples thereof include poly-α olefin oils, alkyldiphenyl ethers, alkylnaphthalenes, dialkyltetraphenyl ethers, fatty acid esters, and mixtures thereof. Besides the hydrocarbon oils, silicone oils, e.g., dimethylpolysiloxane, or fluorine oils, e.g., perfluoropolyether, may also be used. The amount of the low-volatile organic solvent is generally from 40 to 85% by weight based on the magnetic fluid composition.

The surface active agents which can be used in the present invention are those having a lipophilic group having affinity to the above-mentioned low-volatile organic solvent. Examples of suitable surface active agents include anionic surface active agents having a polar group (e.g., a carboxyl group, a hydroxyl group or a sulfonic group), e.g., oleic acid or a salt thereof, petroleum sulfonic acid or a salt thereof, synthetic sulfonic acid or a salt thereof, eicosylnaphthalenesulfonic acid or a salt thereof, polybutenesuccinic acid or a salt thereof, and erucic acid or a salt thereof; nonionic surface active agents, e.g., polyoxyethylene nonylphenyl ether; and amphoteric surface active agents, e.g., alkyldiaminoethylglycine. The amount of the surface active agent is generally from 5 to 20% by weight based on the magnetic fluid composition.

The ferromagnetic fine particles which are coated with the above-mentioned surface active agent and dispersed in the above-mentioned low-volatile organic solvent include ferromagnetic metal oxides, such as magnetite, manganese ferrite, cobalt ferrite, composite ferrites of these ferrite species and zinc or nickel, and barium ferrite; and ferromagnetic metals, such as iron, cobalt, and rare earth metals, or nitrides thereof. The amount of the ferromagnetic fine particles is generally from 10 to 40% by weight based on the magnetic fluid composition.

If desired, the magnetic fluid composition of the present invention may further contain a conductivity-imparting agent, such as a fatty acid and a tertiary amine, as disclosed in JP-A-1-231302 (which corresponds to U.S. Pat. No. 5,135,672) and/or a high polymeric additive, such as polybutenesuccinic acid or sodium polybutenesulfonate, as disclosed in JP-A-4-211104 (which corresponds to U.S. Pat. No. 5,143,637) without lessening the effects of the present invention. Addition of the high polymeric additive brings about improvements in water resistance and heat resistance.

While the present invention has been described chiefly with reference to the embodiments in which the magnetic fluid composition is applied for inner periphery sealing of the gap between the inner periphery of pole pieces and an axis, the magnetic fluid composition according to the present invention is also applicable for outer periphery sealing of the gap between the outer periphery of pole pieces and a housing.

The present invention will now be illustrated in greater detail with reference to Examples and Test Examples, but the present invention should not be construed as being limited thereto. All the percents are by weight unless otherwise indicated.

EXAMPLE 1

Preparation of Lipophilic Magnetite Fine Particles

A magnetite colloidal solution prepared by a known wet process as described in JP-B-4-13842 (the term "JP-B" as used herein means an "examined published Japanese Patent application") was adjusted to pH 3 with a 3N hydrochloric acid aqueous solution, and sodium synthetic sulfonate was added thereto as a dispersant, followed by stirring at 60° C. for 30 minutes. During this step, the dispersant was adsorbed onto the surface of the magnetite fine particles.

The dispersion was allowed to stand to aggregate and precipitate the magnetite fine particles, and the supernatant liquid was discarded. Fresh water was added to the precipitate, the mixture was stirred and then allowed to stand, and the supernatant liquid was discarded. This washing step was repeated several times to remove electrolytes, the aqueous solution was filtered, and the filter cake was dehydrated and dried to obtain surface active agent-coated magnetite fine particles (as powder).

To the magnetite powder was added hexane as a low-boiling organic solvent followed by sufficiently shaking to prepare an intermediate medium (magnetite dispersion in hexane).

To the resulting colloidal dispersion was added methanol as a low-boiling polar organic solvent, the colloidal particles were aggregated and sedimented, and the supernatant liquid was discarded, to thereby remove an excess dispersant which was not adsorbed on the colloidal particles monomolecularly. Then, the sediment was again dispersed in hexane. The dispersion was centrifuged at 8000G for 30 minutes to cause poorly-dispersed particles of relatively large size to be sedimented. The supernatant still having dispersed therein magnetite fine particles was transferred to a rotary evaporator and kept at 90° C. to remove hexane to recover lipophilic magnetite fine particles. The above-mentioned steps are substantially the same as those described in JP-A-3-139596.

Preparation of Conventional Magnetic Fluid Composition

Five grams of the thus prepared lipophilic magnetite fine particles were re-dispersed in hexane, and the dispersion was mixed with a mixed carrier composed of 4.0 g of octadecyldiphenyl ether and 1.0 g of ditetradecyltetraphenyl ether. The mixture was kept at 90° C. in a rotary evaporator to remove hexane thereby dispersing the magnetite fine particles in the carrier. The dispersion was centrifuged at 8000G for 30 minutes to obtain a magnetic fluid composition free from non-dispersed solids.

To the resulting magnetic fluid composition was added 0.9 g of polybutenesuccinic acid (average molecular weight:1100) as a high polymeric additive, followed by thoroughly stirring at 100° C. to dissolve the additive in the composition. There was thus obtained an extremely stable magnetic fluid composition. The above-mentioned steps are substantially the same as those described in Japanese Patent Application No. Hei-4-55443 supra.

The magnetic fluid composition prepared through these steps, i.e., a conventional magnetic fluid composition containing no thixotropic agent, will hereinafter be referred to as a comparative composition.

Preparation of Magnetic Fluid Composition of the Invention

In 30 g of toluene was dispersed 0.15 g of lipophilic smectite (trade name: SAN, manufactured by CO-OP CHEMICAL CO., LTD.) in a high-speed dispersing machine at 8000 rpm for 30 minutes. The resulting smectite dispersion and 10.0 g of the above-prepared comparative composition were mixed, and the mixture was maintained at 90° C. in an evaporator to remove toluene. There was thus obtained a magnetic fluid composition having dispersed therein 1.5% of lipophilic smectite as a thixotropic agent based on the comparative composition (hereinafter designated composition 1).

EXAMPLE 2

Powdered hydrogenated castor oil weighing 0.05 g was mixed with 10.0 g of the comparative composition, and the mixture was stirred at 70° C. in a propeller mixer at 150 rpm for 30 minutes to prepare a magnetic fluid composition containing 0.5% of hydrogenated castor oil based on the comparative composition (hereinafter designated composition 2).

EXAMPLE 3

Anhydrous silica weighing 0.1 g was mixed with 10.0 g of the comparative composition, and the mixture was stirred in a high-speed dispersing machine at 8000 rpm for 30 minutes to prepare a magnetic fluid composition containing 1.0% of anhydrous silica based on the comparative composition (hereinafter designated composition 3).

TEST EXAMPLE 1

Viscosity of each of the comparative composition and compositions 1 to 3 prepared in Examples 1 to 3 was measured with an E-type viscometer (cone-and-plate viscometer) under the following conditions:

Number of Rotation: shown in Table 1.

Shear Rate: shown in Table 1.

Shear Stress: shown in Table 1.

Measuring Temperature: 25° C.

The results obtained are shown in Table 1.

TABLE 1

| Conditions: | | | |
|---|---|---|---|
| Number of Rotation (rpm) | 1 | 5 | 20 |
| Shear Rate ($s^{-1}$) | 2 | 10 | 40 |
| Shear Stress (Pa) | 3.66 | 11.03 | 34.9 |
| Viscosity (mPa · s): | | | |
| Composition 1 | 1800 | 1100 | 850 |
| Composition 2 | 1900 | 1200 | 900 |
| Composition 3 | 1200 | 1100 | 1000 |
| Comparative Composition | 800 | 800 | 800 |

The results in Table 1 prove that the comparative composition (conventional magnetic fluid composition) exhibits Newtonian viscosity behavior, i.e., unchanged viscosity with an increase of the number of rotation of the viscometer, whereas compositions 1 to 3 according to the present invention show thixotropy, i.e., a decrease in viscosity with an increase of the number of rotation of the viscometer. In other words, compositions 1 to 3, when used in a magnetic fluid-sealed apparatus, undergoes a reduction in viscosity in the portion under a rotational force (i.e., seal gap 8 rotating at a high speed) while maintaining its viscosity in the portion receiving no great rotational force (i.e., protrusions 7). The magnetic fluid composition according to the present invention was thus proved to have excellent anti-splash properties.

TEST EXAMPLE 2

Figure 3:
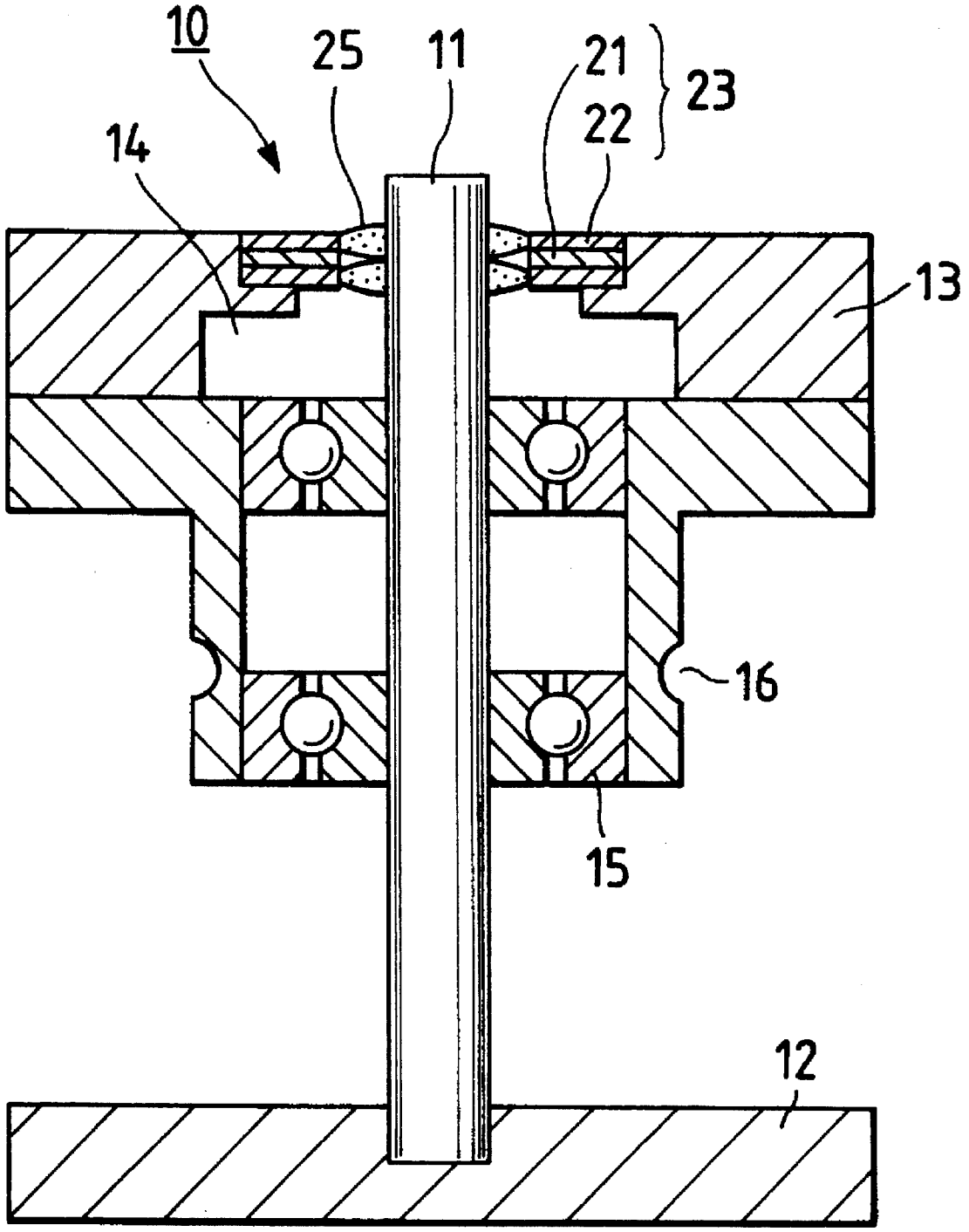
FIG. 3 is a cross sectional view of an apparatus for testing splash of a magnetic fluid composition in a magnetic fluid-sealed apparatus operated at a high rotational speed.

The anti-splash properties of compositions 1 to 3 and the comparative composition were examined with time by use of a high-speed rotary splash tester shown in FIG. 3. All the test compositions used had a saturated magnetic flux density of 370 Gauss.

The splash tester used is composed of stage 12, axis 11 (diameter: 6 mm) made of a magnetic substance which is fixed on stage 12, and hollow housing 13 having space 14 which is fitted around axis 11. Housing 13 can rotate around axis 11 via roller bearing 15. Groove 16 for a belt is provided on the periphery of housing 13. A belt (not shown) is put on groove 16 and a motor-driven pulley wheel (not shown) to rotate housing 13 at an arbitrary speed.

Magnetic fluid-sealed apparatus 10 comprises magnetic circuit-forming member 23 composed of a pair of ring pole pieces 22 having interposed therebetween ring permanent magnet 21 magnetized in its thickness direction. When magnetic fluid-sealed apparatus 10 is mounted on the top of housing 13 with its outer periphery fixed to the inner periphery of housing 13, and the gap between the inner periphery of each pole piece 22 and the periphery of axis 11 is filled with magnetic fluid composition 25 (magnetic fluid composition 25 is held there by the magnetic force), a magnetic circuit is formed, in which a magnetic flux circulates through magnetic circuit-forming member 23 via axis 11.

In this test example, 8 high-speed rotary splash testers were used for each test composition. The 8 splash testers were connected to one driving motor (not shown) equipped with a speed controller via a pulley and belt so that all the tester might rotate simultaneously at the same speed. Magnetic fluid-sealed apparatus 10 was fitted on each splash tester, and a test composition was injected into the gap between axis 11 and each pole piece 22 in an amount sufficient for obtaining a sufficient sealing pressure resistance. Immediately thereafter, housing 13 was rotated at room temperature for 5 minutes at such a speed that the peripheral speed of the sealing portion was fixed at 3.14 m/sec. The number of splash testers in which splash of the test composition occurred during the 5 minutes' rotation was recorded.

Further, the splash test was conducted in the same manner except that rotation of housing 13 was started after allowing the applied test composition to stand for 50 hours or 200 hours.

The results obtained are shown in Table 2 below.

TABLE 2

| Sample | Immediate After Injection | After 50 Hrs' Standing | After 200 Hrs' Standing |
|---|---|---|---|
| Composition 1 | 0 | 0 | 0 |
| Composition 2 | 0 | 0 | 0 |
| Composition 3 | 0 | 0 | 0 |
| Comparative Composition | 0 | 5 | 8 |

As can be seen from Table 2, each of the test compositions inclusive of the comparative one showed excellent anti-splash properties as far as the testing was carried out immediately after the test composition was injected. When the composition was allowed to stand for 50 hours or 200 hours from the injection, the compositions according to the present invention still exhibited excellent anti-splash properties. To the contrary, the comparative composition involved splashing after 50 hours' standing. Splash of the comparative composition occurred in all the testers after 200 hours' standing.

It was thus proved that remarkable improvement in anti-splash properties can be achieved by using a magnetic fluid composition containing a thixotropic agent. The excellent effects of the present invention are believed to be attributed to the network structure of the thixotropic agent by which ferromagnetic fine particles are inhibited from being localized in the portion having a stronger magnetic field. Such localization of ferromagnetic fine particles is regarded as one cause of splash.

As described and demonstrated above, the magnetic fluid composition according to the present invention contains a thixotropic agent which, when used in a small amount, not only functions as a thixotropy-imparting agent but forms a network structure in the carrier.

Where the magnetic fluid composition of the invention is used in an amount necessary for forming a ring seal in a magnetic fluid-sealed apparatus operated at such a high speed that the peripheral speed of the sealing part reaches to 2 m/sec or even more, it reduces its viscosity in the seal gap where a rotational force is imposed while retaining a high viscosity in the protrusion which is not so influenced by the rotational force. As a result, excellent anti-splash properties can be exhibited against the centrifugal force exerted on the sealing part.

Further, when the seal ring is still, because the thixotropic agent spreads in the carrier to form a network structure, ferromagnetic fine particles dispersed in the carrier are effectively prevented from aggregation and localization with time. As a result, the change in the seal pressure resistance with time can be inhibited, and excellent anti-splash properties are retained for a prolonged period of time.

While the invention has been described in detail and with reference to specific examples thereof, it will be apparent to one skilled in the art that various changes and modifications can be made therein without departing from the spirit and scope thereof.

What is claimed is:

1. A magnetic fluid composition comprising a low-volatile organic solvent as a carrier having dispersed therein ferromagnetic fine particles coated with a surface active agent having a lipophilic group having affinity to said low-volatile organic solvent, and a thixotropy-imparting agent, wherein the amount of ferromagnetic fine particles is 10 to 40% by weight based on the magnetic fluid composition, wherein said thixotropy-imparting agent is selected from the group consisting of at least one of organic modified bentonite, lipophilic smectite, organic surface-modified precipitated calcium carbonate of calcite structure, hydrogenated castor oil, a fatty acid amide, and a swelling mica-organic substance complex.

2. A magnetic fluid composition as claimed in claim 1, wherein said thixotropic agent is present in an amount of from about 0.2 to about 3.0% by weight based on the magnetic fluid composition.

* * * * *